US005789669A

United States Patent [19]

Flaum

[11] Patent Number: 5,789,669

[45] Date of Patent: Aug. 4, 1998

[54] METHOD AND APPARATUS FOR DETERMINING FORMATION PRESSURE

[76] Inventor: Charles Flaum, 8 Old Musket La., Ridgefield, Conn. 06877

[21] Appl. No.: 910,383

[22] Filed: Aug. 13, 1997

[51] Int. Cl.[6] ..... E21B 49/00

[52] U.S. Cl. ..... 73/152.51

[58] Field of Search ..... 175/50, 49; 73/152.05, 73/152.52, 152.53

[56] References Cited

U.S. PATENT DOCUMENTS

| | | | |
|---|---|---|---|
| 3,115,775 | 12/1963 | Russell | 73/152.52 |
| 5,065,619 | 11/1991 | Myska | 73/152.51 |
| 5,184,508 | 2/1993 | Desbrandes | 73/152.52 |
| 5,233,866 | 8/1993 | Desbrandes | 73/152.52 |

*Primary Examiner*—Ronald L. Biegel
*Attorney, Agent, or Firm*—Martin M. Novack; Keith G. W. Smith

[57] ABSTRACT

A method is disclosed for determining true formation pressure in formations surrounding a fluid-containing borehole having a mudcake on the surface thereof, including the following steps: with the pressure in the borehole at a first measured borehole pressure, measuring, as a first probe pressure, the pressure in the formation adjacent the mudcake; with the pressure in the borehole at a second measured borehole pressure, measuring, as a second probe pressure, the pressure in the formation adjacent the mudcake; and deriving the true formation pressure from the first and second measured borehole pressures and the first and second probe pressures.

20 Claims, 6 Drawing Sheets

METHOD AND APPARATUS FOR DETERMINING FORMATION PRESSURE

FIELD OF THE INVENTION

This invention relates to the field of well logging of earth boreholes and, more particularly, to the determination of virgin formation pressure of formations surrounding a fluid-containing borehole having a mudcake on the surface thereof.

BACKGROUND OF THE INVENTION

Existing well logging devices can provide useful information about hydraulic properties of formations, such as pressures and fluid flow rates, and can obtain formation fluid samples for uphole analysis. Reference can be made, for example to U.S. Pat. Nos. 3,934,468 and 4,860,581. In a logging device of this general type, a setting arm or setting pistons can be used to controllably urge the body of the logging device against a side of the borehole at a selected depth. The side of the device that is urged against the borehole wall includes a packer which surrounds a probe. As the setting arm extends, the probe is inserted into the formation, and the packer then sets the probe in position and forms a seal around the probe, whereupon formation pressure can be measured and fluids can be withdrawn from the formation. The probe typically penetrates the mudcake and communicates with the formations adjacent the mudcake by abutting or slightly penetrating the formations. The pressure measured with the probe at the formation adjacent the mudcake is sometimes called the "probe pressure" and it can be used as an indicator of the virgin formation pressure, it being understood that there will often be substantial invasion of the near formations. However, the measurement of true formation pressure, especially in relatively low permeability formations, is sometimes rendered difficult or impossible by a phenomenon called "supercharging".

According to one theory, supercharging is caused by the fact that the permeability of mudcake is not exactly zero, but has some small finite value. In low permeability formations, the resistance to fluid flow due to the mudcake can be of the same order of magnitude as the resistance of the formation to accepting the fluid. Thus, a standard wireline pressure measurement, which measures the pressure difference across the mudcake, will not be sufficient to measure the pressure of virgin formation, since there remains (due to the constant fluid flow across the mudcake), a residual finite pressure difference between the formation at the mudcake interface and virgin formation far away.

It is among the objects of the present invention to provide a technique and apparatus that can obtain true formation pressure, even under conditions where supercharging is occurring.

SUMMARY OF THE INVENTION

An explanation of supercharging can be made by analogy to electrical current flow, since Darcy's law and Ohm's law have the same algebraic form. Reference can be made to the diagram of FIG. 1. The pressure difference between the borehole (hydrostatic) and the virgin formation is the driving potential Vbh−Vf. The mudcake is analogous to a relatively high value resistor Rmc. The formation is another resistor, Rf, in series with the mudcake. A high permeability formation is represented by a low formation resistor. In such a case Rmc>>Rf, and the whole potential drop will occur across the mudcake resistor, and a potential measurement across the mudcake Vbh−Vmc will provide the formation potential, as Vmc=Vf. For impermeable formations Rmc<<Rf, and there will be almost no potential difference observed across the mudcake, so Vmc=Vbh.

However, for low permeability formations, where Rmc and Rf are of the same order of magnitude, Vmc will be somewhere between Vbh and Vf. Since Vmc is the analog of the probe pressure measurement taken with the described type of logging tool, it is seen that in this case the true reservoir pressure will not be obtained by having the measurements Vbh and Vmc.

Instead of making a single probe pressure measurement at a point in the well, the well hydrostatic pressure can be used as the driving potential, and additional probe pressure measurements can be made with different driving potentials. From two such measurements, when the difference in the driving pressures is of the same order of magnitude as the difference between the driving pressure and the formation pressure, the formation pressure can be determined. The technique can be extended to several measurements, to improve the precision of the result.

In accordance with an embodiment of the invention, there is provided a method for determining true formation pressure in formations surrounding a fluid-containing borehole having a mudcake on the surface thereof, including the following steps: with the pressure in the borehole at a first measured borehole pressure, measuring, as a first probe pressure, the pressure in the formation adjacent the mudcake; with the pressure in the A borehole at a second measured borehole pressure, measuring, as a second probe pressure, the pressure in the formation adjacent the mudcake; and deriving the true formation pressure from the first and second measured borehole pressures and the first and second probe pressures.

In situations where the borehole hydrostatic pressure will naturally vary over a short period of time (for example, in certain floating rig situations), it may not be necessary to vary the hydrostatic pressure. In such cases, the readings of hydrostatic pressure as a function of time will show pressure variations, and if they are significant, the pressures measured with the probe can be utilized, in conjunction with the hydrostatic borehole pressure measurements, in practicing an embodiment of the invention. In other situations, the borehole hydrostatic pressure can be varied in any suitable way. For example, the hydrostatic pressure in the well can be increased by pumping into the well from the earth's surface using the mud pumping equipment (not shown). Conversely, the hydrostatic pressure in the well could be lowered by removing some fluid from the well, although in some circumstances this would not be recommended from a safety standpoint. Borehole pressure variation can also be localized to the region in which measurements are being made. For example, a region of the borehole can be isolated using dual packers and the pressure within the isolated region of the borehole can be modified by pumping to or from (preferably to) the isolated region. In one embodiment hereof, this is implemented by providing packers and a pump-out module as part of the apparatus used to perform the pressure measurements.

A technique in accordance with a further form the invention, wherein borehole pressure is locally modified, includes the following steps: suspending a logging device in the borehole; measuring the pressure in the borehole in the region of the logging device to obtain a first measured borehole pressure and measuring, as a first probe pressure, the pressure in the formation adjacent the mudcake in the region of the logging device; modifying, with the logging device, the pressure in the borehole in said region of the logging device; measuring the pressure in the borehole in the region of the logging device to obtain a second measured borehole pressure and measuring, as a second probe pressure, the pressure in the formation adjacent the mudcake in the region of the logging device; and deriving the true formation pressure from the first and second measured borehole pressures and the first and second probe pressures.

Further features and advantages of the invention will become more readily apparent from the following detailed description when taken in conjunction with the accompanying drawings.

DETAILED DESCRIPTION

Figure 2:
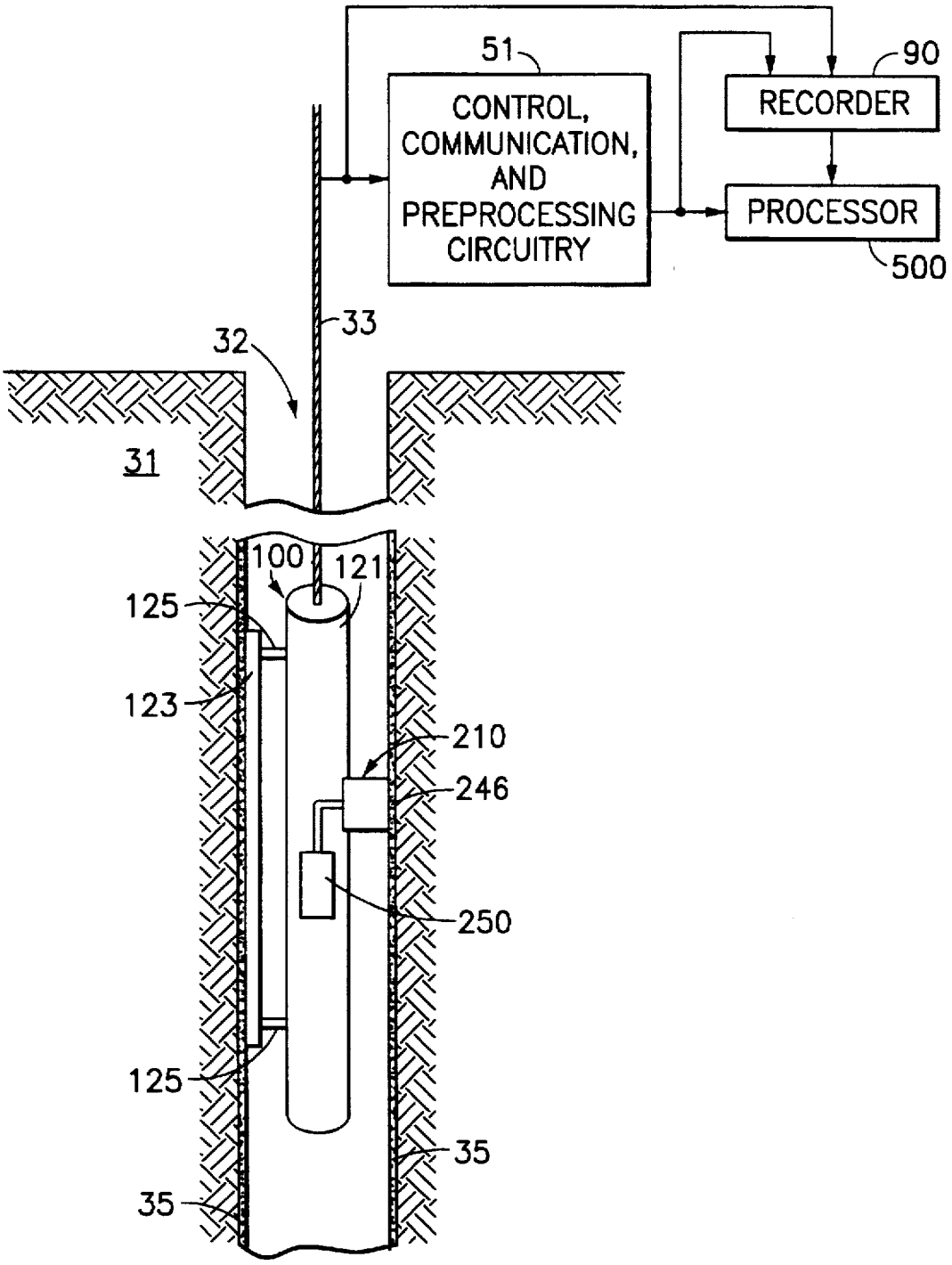
FIG. 2 is a schematic diagram, partially in block form, of an apparatus that can be used in practicing an embodiment of the invention.

Referring to FIG. 2 there is shown a representative embodiment of an apparatus for investigating subsurface formations 31 traversed by a borehole 32, which can be used in practicing embodiments of the invention. The borehole 32 is typically filled with a drilling fluid or mud which contains finely divided solids in suspension. A mudcake on the borehole wall is represented at 35. The investigating apparatus or logging device 100 is suspended in the borehole 32 on an armored multiconductor cable 33, the length of which substantially determines the depth of the device 100. Known depth gauge apparatus (not shown) is provided to measure cable displacement over a sheave wheel (not shown) and thus the depth of the logging device 100 in the borehole 32. The cable length is controlled by suitable means at the surface such as a drum and winch mechanism (not shown). Circuitry 51, shown at the surface although portions thereof may typically be downhole, represents control, communication and preprocessing circuitry for the logging apparatus. This circuitry may be of known type.

The logging device or tool 100 has an elongated body 121 which encloses the downhole portion of the device controls, chambers, measurement means, etc. Reference can be made, for example, to the above-mentioned U.S. Pat. Nos. 3,934,468 and 4,860,581, which describe devices of suitable general type. One or more arms 123 can be mounted on pistons 125 which extend, e.g. under control from the surface, to set the tool. The logging device includes one or more probe modules that include a probe assembly 210 which is movable with a probe actuator (not separately shown) and includes a probe 246 that is outwardly displaced into contact with the borehole wall, piercing the mudcake 35 and communicating with the formations. The equipment and methods for taking individual hydrostatic pressure measurements and/or probe pressure measurements are well known in the art, and the logging device 100 is provided with these known capabilities. Probe 246 is illustrated as communicating with a i block 250 that represents the subsystem of gauges and associated electronics for measuring the desired pressures and producing electrical signals representative thereof that can be communicated to the earth's surface.

Figure 1:
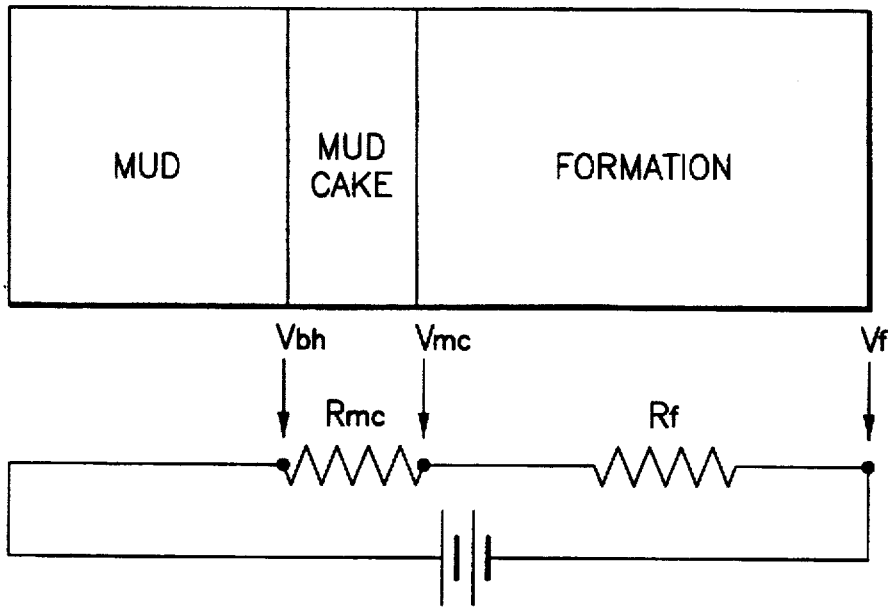
FIG. 1 is a circuit diagram that is a simplified analog of the borehole, mudcake, and formation, which is useful in understanding the improvements of the invention.

As first summarized above, an explanation of supercharging can be made by analogy to electrical current flow, since Darcy's law and Ohm's law have the same algebraic form. Reference can again be made to the diagram of FIG. 1. The pressure difference between the borehole (hydrostatic) and the virgin formation is the driving potential Vbh−Vf. The mudcake is analogous to a relatively high value resistor Rmc. The formation is another resistor, Rf, in series with the mudcake. A high permeability formation is represented by a low formation resistor. In such a case Rmc>>Rf, and the whole potential drop will occur across the mudcake resistor, and a potential measurement across the mudcake Vbh−Vmc will provide the formation potential, as Vmc=Vf. For impermeable formations Rmc <<Rf, and there will be almost no potential difference observed across the mudcake, so Vmc=Vbh.

However, as previously noted, for low permeability formations, where Rmc and Rf are of the same order of magnitude, Vmc will be somewhere between Vbh and Vf. Since Vmc is the analog of the probe pressure measurement taken with the described type of logging tool, it is seen that in this case the true reservoir pressure will not be obtained by having the measurements Vbh and Vmc.

Using the analogy to electrical current, since the current (fluid flow) across the mudcake, across Rmc, is the same as the current into the formation, across Rf, one can say that $$(Vbh-Vf)/(Rmc+Rf)=(Vbh-Vmc)/Rmc \quad (1)$$

For two different Vbh measurements Vbh1 and Vbh2, with corresponding Vmc1 and Vmc2, the relationships are:

$$(Vbh-Vf)/(Rmc+Rf)=(Vbh1-Vmc1)/Rmc \quad (2)$$

$$(Vbh2-Vf)/(Rmc+Rf)=(Vbh2-Vmc2)/Rmc \quad (3)$$

Dividing equation (2) by equation (3) gives $$(Vbh1-Vf)/(Vbh2-Vf)=(Vbh1-Vmc1)/(Vbh2-Vmc2) \quad (4)$$

Vf can be obtained by solving equation (4), as all other V's are either known or measured:

$$Vf=(\text{Ratio}*Vbh2-Vbh1)/(\text{Ratio}-1) \quad (5)$$

Where:

$$\text{Ratio}=(Vbh1Vmc1)/(Vbh2-Vmc2) \quad (6)$$

In this analogy V's are the pressures; that is, Vbh is the pressure in the borehole ($P_{bh}$) Vf is the true formation pressure ($P_f$), and Vmc is the probe derived pressure ($P_{pr}$).

Figure 3:
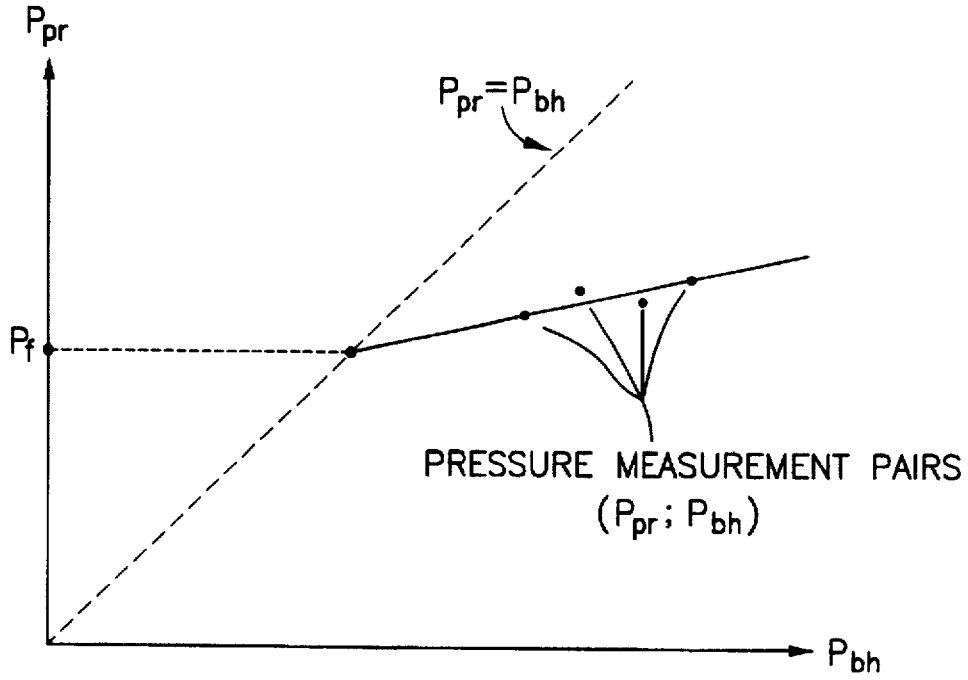
FIG. 3 is a graph of probe pressure versus borehole pressure that is useful in understanding operation of an embodiment of the invention.

The technique hereof can be extended to more than two measurements, to improve the precision of the result. In this case, the $P_f$ can be obtained graphically, as shown in FIG. 3. On the plot of $P_{pr}$ versus $P_{bh}$ which contains pressure measurement data pair points ($P_{bh}$, $P_{pr}$), the true formation pressure $P_f$ is obtained at the point where the line drawn through the data points (for example a straight line using a least squares fit) crosses the $P_{pr}=P_{bh}$ line, since under this condition there would be no flow through the mudcake so $P_f=P_{bh}$. A suitable curved line or function could alternatively be used.

Figure 4:
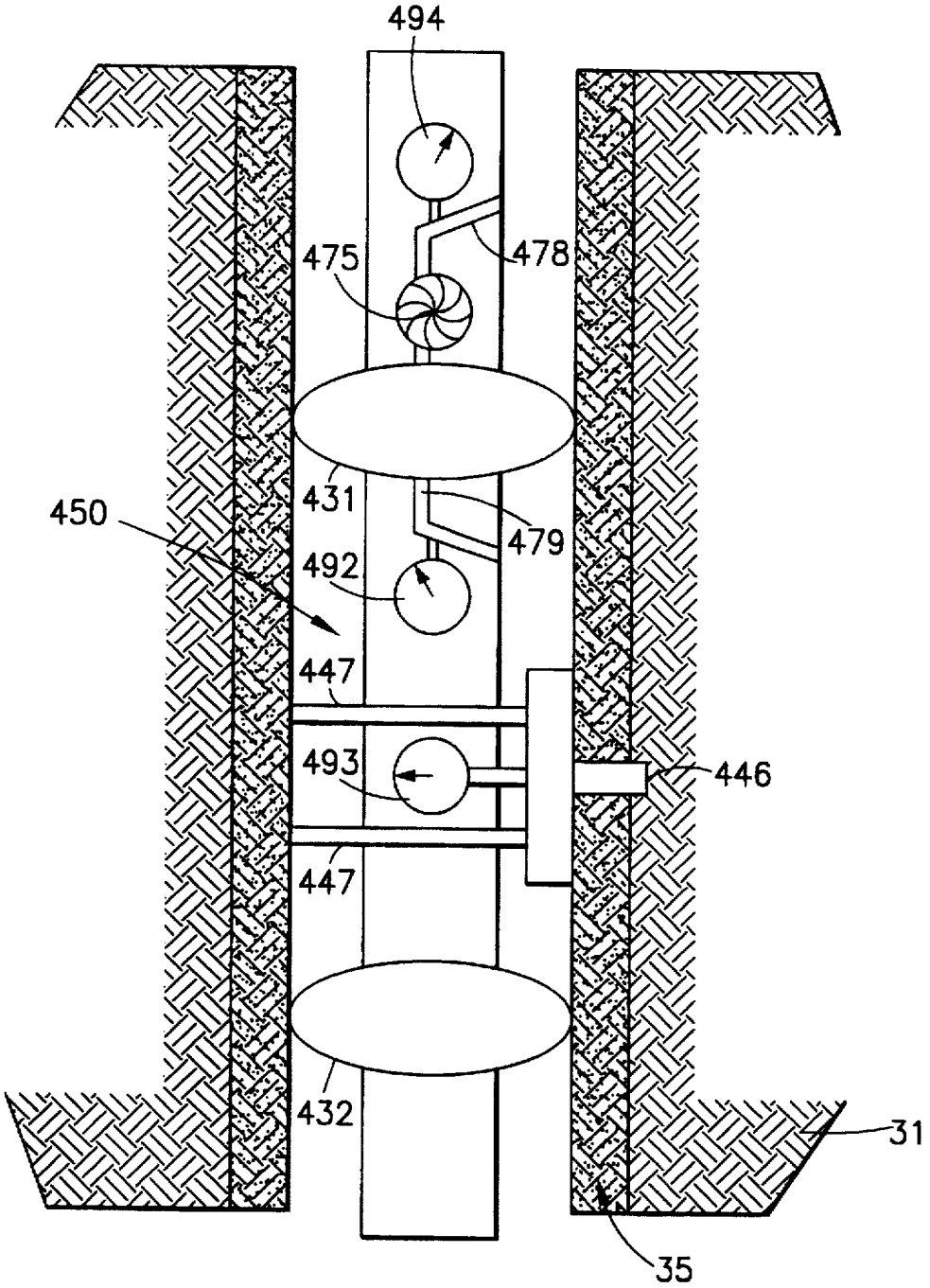
FIG. 4 is a simplified schematic diagram of an apparatus in accordance with another embodiment of the invention.

Referring to FIG. 4, there is shown an embodiment of a well logging device 400 that can be suspended in the borehole as in the FIG. 2 embodiment, and which can be used to practice a form of the invention wherein the variation in borehole pressure is implemented by the logging device itself (which for purposes hereof includes any downhole equipment coupled with the logging tool) and is localized in the region where the device is positioned in the borehole at a given time. The device 400 of FIG. 4 can include all the capabilities of the FIG. 2 logging device, and will have the indicated probe or probes, pressure measuring capabilities, etc. The device 400 also includes inflatable packers 431 and 432, which can be of a type that is known in the art, together with suitable activation means (not shown). Reference can be made, for example, to U.S. Pat. No. 4,860,581 which describes operation of a packer used in conjunction with a logging device. When inflated, the packers 431 and 432 isolate the region 450 of the borehole, and the probe 446, shown with setting pistions 447, operates from within the isolated region. A pump-out module 475, which can be of a known type (see, for example, U.S. Pat. No. 4,860,581, includes a pump and a valve, and the pump-out module 475 communicates via a line 478 with the borehole outside the isolated region 450, and via a line 479, through the packer 431, with the isolated region 450 of the borehole. The packers 431, 432 and the pump-out module 475 can be controlled from the surface. The borehole pressure in the isolated region is measured by pressure gauge 492, and the probe pressure is measured by the pressure gauge 493. The borehole pressure outside the isolated region can be measured by pressure gauge 494.

Figure 5:
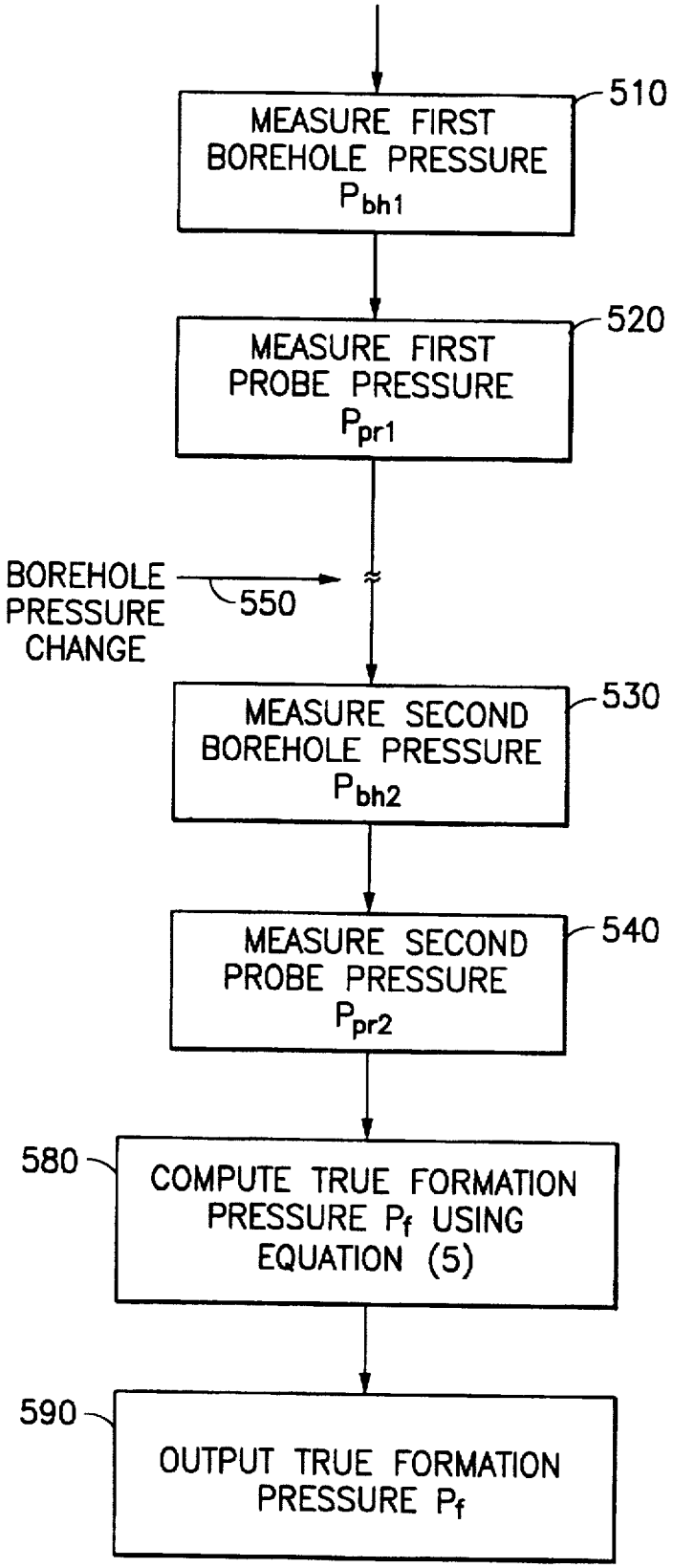
FIG. 5 is a flow diagram that represents steps of a technique in accordance with an embodiment of the invention.

Referring to FIG. 5, there is shown a diagram of the steps that can be implemented in practicing an embodiment of the invention. The technique can be performed under processor control (either from an uphole or downhole processor), or by a combination of processor control and uphole operator control. The block 510 represents measuring (and, in all cases, storing) of a first borehole pressure, $P_{bh1}$, and the block 520 represents the measuring of a first probe pressure $P_{pr1}$. The pressure measurements can be implemented in the manner previously described. Next, the arrow 550 represents the change in borehole pressure which, as noted above, can occur naturally in certain circumstances or can be achieved by pumping on the well or by the previously described technique of local pressure modification. The block 530 represents measurement of the second borehole pressure Pbh2, and the block 540 represents measurement of a second probe pressure $P_{pr2}$. Then, the block 580 represents computation of the true formation pressure using the measured pressures and equation (5) above, and the block 590 represents reading out of the true formation pressure.

Figure 6:
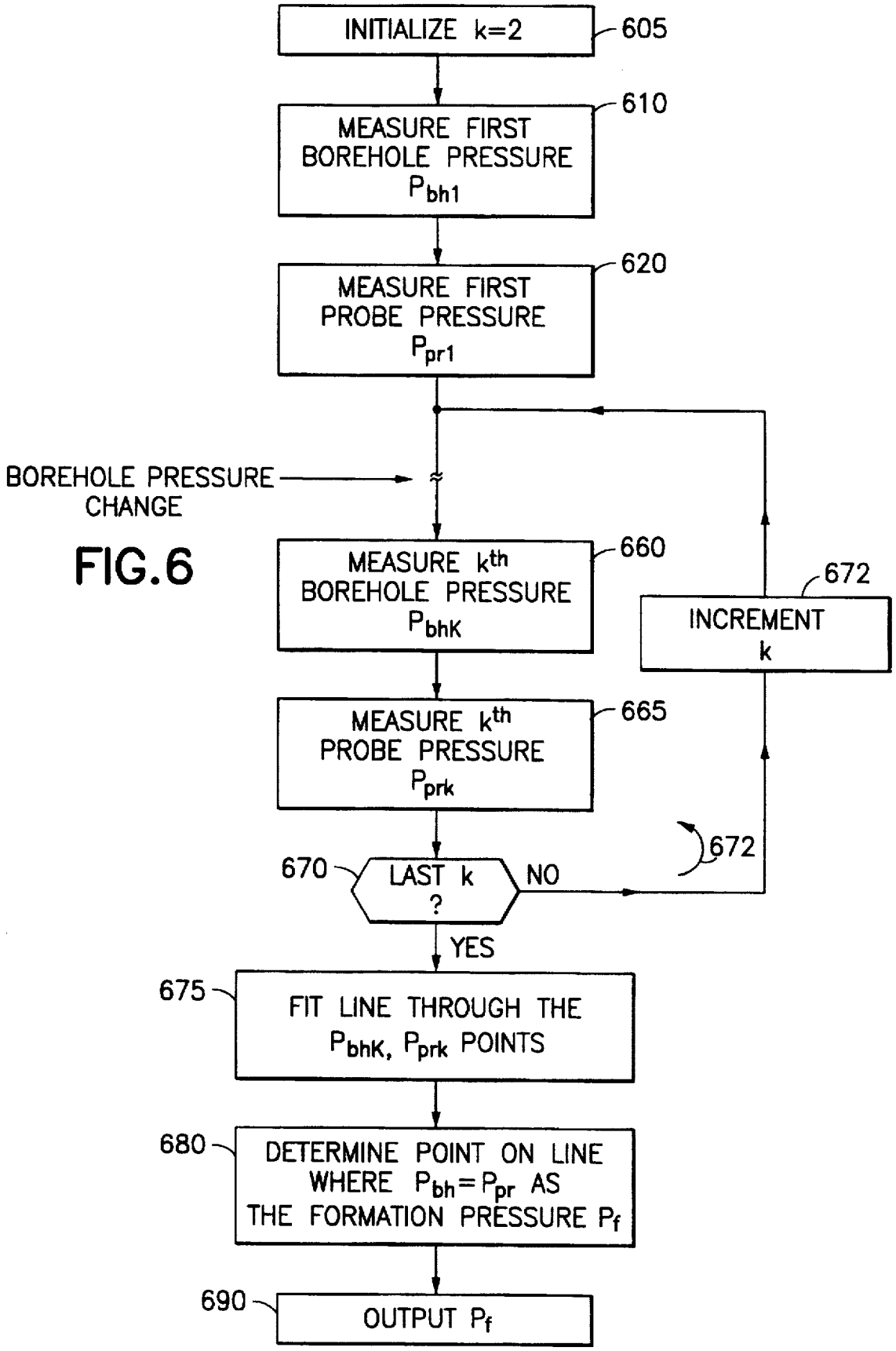
FIG. 6 is a flow diagram that represents steps of a technique in accordance with another embodiment of the invention.

In the routine represented in conjunction with the diagram of FIG. 6, several pressure measurement pairs ($P_{bhk}$, $P_{prk}$) are utilized to determine the relationship therebetween, and extrapolation can then be used to determine the true formation pressure. An index k is initialized at 2 (block 605), and the blocks 610 and 620 represent the measurement of the first borehole pressure $P_{bh1}$ and the first probe pressure $P_{pr1}$, as in the corresponding blocks 510 and 520 of FIG. 5. Also as in FIG. 5, the arrow 550 represents a borehole pressure change, whereupon the blocks 660 and 665 are entered, these blocks respectively representing measurement of the kth borehole pressure $P_{bhk}$ and the kth probe pressure $P_{prk}$, k being 2 for this first time through the loop 662. Inquiry is then made (decision block 670) as to whether the predetermined last k has been reached. If not, k is incremented (block 672), the next borehole pressure change (by whatever phenomenon or means is operative) is awaited, and the loop 662 is continued until the last k is reached. Then, a line or curve can be fit through the ($P_{prk}$, $P_{prk}$) points, as represented by the block 675 and as was described above, for example in conjunction with FIG. 3. Then, as represented by block 680 the point on the line where $P_{pr}=P_{bh}$ can be determined, as was also described in conjunction with FIG. 3, and the true formation pressure, $P_f$, can then be read out (block 690).

The invention has been described with reference to particular preferred embodiments, but variations within the spirit and scope of the invention will occur to those skilled in the art. For example, although the probe in the illustrated embodiments provides absolute pressure measurements, it will be understood that the probe my alternatively provide measurements with respect to another pressure, for example measurements with respect to borehole pressure.

I claim:

1. A method for determining true formation pressure in formations surrounding a fluid containing borehole having a mudcake on the surface thereof, comprising the steps of:

with the pressure in the borehole at a first measured borehole pressure, measuring, as a first probe pressure, the pressure in the formation adjacent the mudcake;

with the pressure in the borehole at a second measured borehole pressure, measuring, as a second probe pressure, the pressure in the formation adjacent the mudcake; and deriving the true formation pressure from said first and second measured borehole pressures and said first and second probe pressures.

2. The method as defined by claim 1, wherein said first and second measured borehole pressures are $P_{bh1}$ and $P_{bh2}$, respectively, and wherein said first and second probe pressures are $P_{pr1}$ and $P_{pr2}$, and wherein said deriving step comprises deriving said true formation pressure as $$P_f=(\text{Ratio}*P_{bh2}-V_{bh1})/(\text{Ratio}-1)$$

where $$\text{Ratio}=(P_{bh1}-P_{pr1})/(P_{bh2}-P_{pr2}).$$

3. The method as defined by claim 1, further comprising the following steps:

with the pressure in the borehole at a third measured borehole pressure, measuring, as a third probe pressure, the pressure in the formation adjacent the mudcake;

and wherein said deriving step comprises deriving said true formation pressure from said first, second, and third measured borehole pressures and said first, second, and third probe pressures.

4. The method as defined by claim 3, wherein said deriving step comprises determining, from said first borehole pressure and first probe pressure, second borehole pressure and second probe pressure, and third borehole pressure and third probe pressure, the relationship between borehole pressure and probe pressure, and determining said true formation pressure from said relationship.

5. The method as defined by claim 3, wherein said first, second, and third measured borehole pressures are $P_{bh1}$, $P_{bh2}$ and $P_{bh3}$, respectively, and wherein said first, second, and third probe pressures are $P_{pr1}$, $P_{pr2}$ and $P_{pr3}$, respectively, and wherein said deriving step comprises: determining a line through points ($P_{bh1}$, $P_{pr1}$), ($P_{bh2}$, $P_{pr2}$) and ($P_{bh3}$, $P_{pr3}$) of a plot of probe pressure versus measured borehole pressure, and determining the point on said line where probe pressure equals borehole pressure, the true formation pressure being the pressure at said determined point.

6. The method as defined by claim 1, further comprising the following steps:

with the pressure in the borehole at each of a multiplicity of successively further measured borehole pressures, measuring, as respective further probe pressures, the pressure in the formation adjacent the mudcake;

and wherein said deriving step comprises deriving said true formation pressure from said first, second and further measured borehole pressures and said first, second and further probe pressures.

7. A method for determining true formation pressure in formations surrounding a fluid-containing borehole having a mudcake on the surface thereof, comprising the steps of:

measuring the pressure in the borehole to obtain a first measured borehole pressure, and measuring, as a first probe pressure, the pressure in the formation adjacent the mudcake;

modifying the pressure in the borehole, and measuring the pressure in the borehole to obtain a second measured borehole pressure, and measuring, as a second probe pressure, the pressure in the formation adjacent the mudcake; and deriving the true formation pressure from said first and second measured borehole pressures and said first and second probe pressures.

8. The method as defined by claim 7, wherein said first and second measured borehole pressures are $P_{bh1}$ and $P_{bh2}$, respectively, and wherein said first and second probe pressures are $P_{pr1}$ and $P_{pr2}$, and wherein said deriving step comprises deriving said true formation pressure as $$P_f=(\text{Ratio}*P_{bh2}-V_{bh1})/(\text{Ratio}-1)$$

where $$\text{Ratio}=(P_{bh1}-P_{pr1})/(P_{bh2}-P_{pr2}).$$

9. The method as defined by claim 7, further comprising the following steps:

further modifying the pressure in the borehole and measuring the pressure in the borehole to obtain a third measured borehole pressure, and measuring, as a third probe pressure, the pressure in the formation adjacent the mudcake;

and wherein said deriving step comprises deriving said true formation pressure from said first, second, and third measured borehole pressures and said first, second, and third probe pressures.

10. The method as defined by claim 9, wherein said deriving step comprises determining, from said first borehole pressure and first probe pressure, second borehole pressure and second probe pressure, and third borehole pressure and third probe pressure, the relationship between borehole pressure and probe pressure, and determining said true formation pressure from said relationship.

11. The method as defined by claim 9, wherein said first, second, and third measured borehole pressures are $P_{bh1}$, $P_{bh2}$ and $P_{bh3}$, respectively, and wherein said first, second, and third probe pressures are $P_{pr1}$, $P_{pr2}$ and $P_{pr3}$, respectively, and wherein said deriving step comprises: determining a line through points ($P_{bh1}$, $P_{pr1}$), ($P_{bh2}$, $P_{pr2}$) and ($P_{bh3}$, $P_{pr3}$) of a plot of probe pressure versus measured borehole pressure, and determining the point on said line where probe pressure equals borehole pressure, the true formation pressure being the pressure at said determined point.

12. A method for measuring true formation pressure in formations surrounding a fluid-containing borehole having a mudcake on the surface thereof, comprising the steps of:

suspending a logging device in the borehole;

measuring the pressure in the borehole in the region of the logging device to obtain a first measured borehole pressure and measuring, as a first probe pressure, the pressure in the formation adjacent the mudcake in said region of the logging device;

modifying, with said logging device, the pressure in the borehole in said region of the logging device;

measuring the pressure in the borehole in said region of the logging device to obtain a second measured borehole pressure and measuring, as a second probe pressure, the pressure in the formation adjacent the mudcake in said region of the logging device; and deriving the true formation pressure from said first and second measured borehole pressures and said first and second probe pressures.

13. The method as defined by claim 12, wherein said first and second measured borehole pressures are $P_{bh1}$ and $P_{bh2}$, respectively, and wherein said first and second probe pressures are $P_{pr1}$ and $P_{pr2}$, and wherein said deriving step comprises deriving said true formation pressure as $$P_f=(\text{Ratio}*P_{bh2}-V_{bh1})/(\text{Ratio}-1)$$

where $$\text{Ratio}=(P_{bh1}-P_{pr1})/(P_{bh2}-P_{pr2}).$$

14. The method as defined by claim 12, further comprising the following steps:

further modifying, with said logging device, the pressure in the borehole in said region of the logging device and measuring the pressure in the borehole in said region of the logging device to obtain a third measured borehole pressure and measuring, as a third probe pressure, the pressure in the formation adjacent the mudcake in said region of the logging device;

and wherein said deriving step comprises deriving said true formation pressure from said first, second, and third measured borehole pressures and said first, second, and third probe pressures.

15. The method as defined by claim 14, wherein said deriving step comprises determining, from said first borehole pressure and first probe pressure, second borehole pressure and second probe pressure, and third borehole pressure and third probe pressure, the relationship between borehole pressure and probe pressure, and determining said true formation pressure from said relationship.

16. The method as defined by claim 14, wherein said first, second, and third measured borehole pressures are $P_{bh1}$, $P_{bh2}$ and $P_{bh3}$, respectively, and wherein said first, second, and third probe pressures are $P_{pr1}$, $P_{pr2}$ and $P_{pr3}$, respectively, and wherein said deriving step comprises: determining a line through points ($P_{bh1}$, $P_{pr1}$), ($P_{bh2}$, $P_{pr2}$) and ($P_{bh3}$, $P_{pr3}$) of a plot of probe pressure versus measured borehole pressure, and determining the point on said line where probe pressure equals borehole pressure, the true formation pressure being the pressure at said determined point.

17. Apparatus for measuring true formation pressure in formations surrounding a fluid-containing borehole having a mudcake on the surface thereof, comprising:

a logging device suspendible in the borehole;

means in said logging device for measuring the pressure in the borehole in the region of the logging device to obtain a first measured borehole pressure and for measuring, as a first probe pressure, the pressure in the formation adjacent the mudcake in said region of the logging device;

means for modifying, with said logging device, the pressure in the borehole in said region of the logging device;

means in said logging device for measuring the pressure in the borehole in said region of the logging device to obtain a second measured borehole pressure and for measuring, as a second probe pressure, the pressure in the formation adjacent the mudcake in said region of the logging device; and means for deriving the true formation pressure from said first and second measured borehole pressures and said first and second probe pressures.

18. Apparatus as defined by claim 17, wherein said means for modifying the pressure in said region comprises means for isolating said region and means for modifying the fluid content of said isolated region.

19. Apparatus as defined by claim 18, wherein said means for isolating said region comprises inflatable packers at the ends of said region.

20. Apparatus as defined by claim 18, wherein said means for modifying the pressure in said region comprises means for pumping mud into said region.

* * * * *